US005305675A

United States Patent [19]

Lasner

[11] Patent Number: 5,305,675

[45] Date of Patent: Apr. 26, 1994

[54] HAND ACTUATED TREMOLO ASSEMBLY

[76] Inventor: Richard Lasner, 17621 Lemay Pl., Van Nuys, Calif. 91406

[21] Appl. No.: 876,720

[22] Filed: Apr. 9, 1992

[51] Int. Cl.[5] ..... G10D 3/00

[52] U.S. Cl. ..... 84/313

[58] Field of Search ..... 84/209, 290, 298, 313, 84/267, 291, 307

[56] References Cited

U.S. PATENT DOCUMENTS

| | | | |
|---|---|---|---|
| 2,741,146 | 4/1956 | Fender | 84/313 |
| 3,162,083 | 12/1964 | Webster | 84/313 |
| 4,171,661 | 10/1979 | Rose | 84/313 |
| 4,555,970 | 12/1985 | Rose | 84/313 |
| 4,852,448 | 8/1989 | Hennessey | 84/313 |

*Primary Examiner*—Michael L. Gellner
*Assistant Examiner*—P. Stanzione
*Attorney, Agent, or Firm*—Brumbaugh, Graves, Donohue & Raymond

[57] ABSTRACT

A hand-actuated tremolo assembly for an acoustic guitar having a mounting structure for the tremolo device is provided. The tremolo device includes a base plate which is anchored to the guitar by means of a mounting structure disposed on the inside of the sound box of the guitar, and is moveable against stationary pivots by means of an actuator disposed outside of the sound box of the guitar, on the face of tremolo device, for the purpose of varying the tension of the strings of the guitar.

20 Claims, 3 Drawing Sheets

HAND ACTUATED TREMOLO ASSEMBLY

FIELD OF THE INVENTION

This invention relates generally to musical instruments and specifically acoustic guitars, and more particularly to hand actuated tremolo devices used with such guitars, which while capable of varying the tension of the guitar strings, are constructed and mounted to the guitar in such a manner so as to preserve the true acoustic sound of and eliminate any excessive stress placed upon the acoustic guitar sound box.

BACKGROUND OF THE INVENTION

Many tremolo devices for electric guitars are known and available to those skilled in the guitar art. Though a useful and expressive tool for the electric guitarist, existing tremolo devices designed for use with electric guitars contain common faults that limit if not prevent their use with acoustic guitars.

One such fault is that the design of existing tremolo devices is such that the device alters the sound of an acoustic guitar in a manner considered undesirable to those skilled in the guitar art. As is well known, the sound produced by a standard acoustic guitar are significantly influenced by the manner in which the strings make contact with the fixed bridge of the guitar, as well as by the materials from which the fixed bridge is made. It is important that the bridge plate be formed of a porous, wooden material in order to produce the resonant characteristics considered acceptable for acoustic guitar tone.

Citing U.S. Pat. Nos. 2,741,146 to C. L. Fender, and 4,171,661 to Floyd Rose, as examples of prior art, it may be seen that customary construction of tremolo devices consists of a bridge plate of a metal material that differs greatly from the porous, wooden material necessary to produce acceptable acoustic guitar tone. Moreover, the soft nature of the porous wooden material needed to produce acceptable acoustic guitar tone from the guitar bridge is insufficiently strong to withstand the upwards of 400 pounds of stress exerted upon it by the combined tension of the strings and tremolo counterbalancing springs during the rocking motion of said bridge plate against fixed pivots necessary to accomplish the goal of raising and lowering the tension of the guitar strings to produce the desired tremolo effect.

It may also be observed in the sound-producing qualities of a standard fixed acoustic guitar bridge that one continuous string saddle of a width appropriate to span all strings on the guitar, made of bone, plastic or other material is friction-fit into a slot in the bridge plate so that the saddle contacts the bridge plate on all surfaces excepting the top surface. The strings, under tension, contact the top surface of the string saddle producing a downward force upon said string saddle, which in turn transfers the vibration of the strings into the bridge plate through all the points of contact that the string saddle makes with the bridge plate, creating acceptable acoustic guitar tone.

In the above cited patents, it will be noted that the customary practice for tremolo device design is to provide individual metal string saddles for each string on the guitar. The saddles are held against the top surface of the metal bridge plate in U.S. Pat. No. 2,741,146 by string tension and in U.S. Pat. No. 4,171,661 by a screw through each saddle. Neither of these customary methods are capable of transferring the vibration of the guitar string through the bridge plate in a manner consistent with the production of acceptable acoustic guitar tone.

Another fault of existing tremolo devices is that attachment of the device to the acoustic guitar places excessive stress on the top sound board of the acoustic guitar sound box. This in turn promotes the failure of the top board. It is customary for the top of the sound box of an acoustic guitar to be constructed from spruce or other similar soft wood in a thickness of no greater than ⅛ inch. When properly supported by suitable braces located on the underside of the top, spruce or other similar soft wood is able to withstand upwards of 200 lbs. of pull exerted by the strings at the site of a standard fixed bridge. It should be noted that the stress applied to the top by the tension of the strings is absorbed by the entire surface area where the standard fixed bridge and top join, thus spreading the stress over an area of sufficient size to withstand the tension without causing the top to fail.

The customary method for attaching a tremolo device to an electric guitar is by threading screws at least ½ inch in length into the top surface of a solid body guitar as anchors for the tremolo device base plate, as described in U.S. Pat. Nos. 2,741,146 and 4,171,661. The tremolo bridge is then pulled against the screws by the tension of the strings. The screws, which are perpendicular to the top of the guitar body, must absorb the full tension of the strings as well as remain upright against the rocking motion of the tremolo bridge when the device is in use. In a solid body guitar, there exists sufficient wood surrounding the screws to allow use and mounting of the tremolo device without damage to the body of the instrument.

Regarding an acoustic guitar, however, as will be clear to those skilled in the art, spruce (the type of material used for acoustic guitars), as referenced in *Machinery's Handbook*, 21st edition, under "Permissible Working Stresses for Structural Timbers (U.S. government tests)", has the ability to withstand compression of 250 p.s.i. perpendicular to the grain of the timber. And, in the thickness required for acoustic guitars, i.e., ⅛ inch or less, spruce, with this compression rating, is unable to support the screws necessary for mounting a tremolo device without severe damage to the top sound board of an acoustic guitar. Further, the spruce top, with a rating of 250 p.s.i. against compression perpendicular to the grain, and a thickness of ⅛ inch or less, cannot withstand the combined stress of 400 lbs. of tension placed against the mounting screws by the strings and tremolo counterbalancing springs. This would cause the mounting screws to move from the perpendicular position required for the tremolo device to operate properly.

Accordingly, the prior art devices are incapable of or at the very least impracticable for use with acoustic guitars.

SUMMARY OF THE INVENTION

It is thus an object of the present invention to provide a tremolo arrangement having guitar bridge capable of producing acceptable acoustic guitar tone and at the same time capable of withstanding the excess stress exerted upon it by the combined tension of the strings and tremolo counterbalancing springs as described above. In accordance with the present invention, a soft, porous top plate is provided connected to a metal base plate which together provide acceptable guitar tone and a surface of sufficient strength so as to withstand the forces and tension exerted by the strings o the device during the action of raising and lowering the tension of said strings to provide the desired tremolo effect.

It is a further object of the present invention to provide a means capable of transferring the vibration of the acoustic guitar string through the bridge plate in a manner consistent with the production of acceptable guitar tone. In accordance with the present invention, a single saddle means is provided spanning all strings on the guitar and affixed in a manner consistent with the production of acceptable acoustic guitar tone as outlined above.

It is still another object of the present invention to provide a structure for mounting the tremolo device upon the sound box of an acoustic guitar in a manner to preserve the top sound board and acceptable acoustic guitar tone.

In accordance with the invention, a mounting structure is disposed on the inside of the sound box to provide both the appropriate means for mounting the tremolo device to the instrument without failure of the top sound board, and the means for preserving acceptable acoustic guitar tone. The internal mounting structure for the tremolo device preferably consists of a top plate, back plate and four vertical connecting pieces, which are joined together to form a box-like structure. This complete structure is preferably glued into place inside the acoustic guitar sound box directly beneath the area of the top sound board where the tremolo device is affixed. This operation is performed before the back of the acoustic guitar sound box is attached during the production of the instrument. The structure is glued in place in such a way as to contact, and be firmly glued to, the inside surfaces of both the top sound board and the sound box back. The components of the internal mounting structure are fabricated from hard maple which, as referenced in *Machinery's Handbook,* 21st edition, under "Permissible Working Stresses for Structural Timbers (U.S. government texts)", has a rating of 500 p.s.i. against compression perpendicular to the grain of the timber. The top plate of the internal mounting structure measures no less than 1 ¾ inches in thickness at the point where the necessary mounting screws are threaded into said top plate. The hard maple top plate, which is supported by hard maple vertical connecting pieces and a hard maple back plate, and is glued securely in place as described above, will possess sufficient strength to withstand the stress and forces of string tension and tremolo counterbalancing springs and will secure the necessary mounting screws and hold them in a perpendicular relationship to the top sound board, allowing operation of the tremolo device, without damage to said top sound board.

It may also be observed in the construction of an acoustic guitar with a standard fixed bridge, that a number of supporting braces attached to the underside of the top sound board contact the area beneath the fixed bridge. String vibration is transferred through the bridge, into the supporting braces and out across the braces into the top sound board. The transference of string vibration in this manner contributes to the production of acoustic guitar tone. In accordance with the present invention, the internal mounting structure abuts at least one of the braces glued to the underside of the top sound board, transferring string vibration from the tremolo bridge to the top sound board. It is this method of transferring string vibration from the bridge to the top sound board that contributes in allowing the tremolo device mounting structure to maintain the integrity of the acoustic guitar tone.

To cure the above-mentioned deficiencies of existing tremolo devices in relation to their use with an acoustic guitar, the present invention provides a tremolo device and attendant mounting structure for mounting the device to an acoustic guitar that does not alter the sound of an acoustic guitar in an undesirable manner and does not place excessive stress on the top sound board of an acoustic guitar.

BRIEF DESCRIPTION OF THE DRAWINGS

The foregoing objects, features and advantages of the present invention will be understood more fully from the following detailed description thereof when taken in conjunction with the a drawings in which.

DETAILED DESCRIPTION OF THE INVENTION

Figures 1, 6:
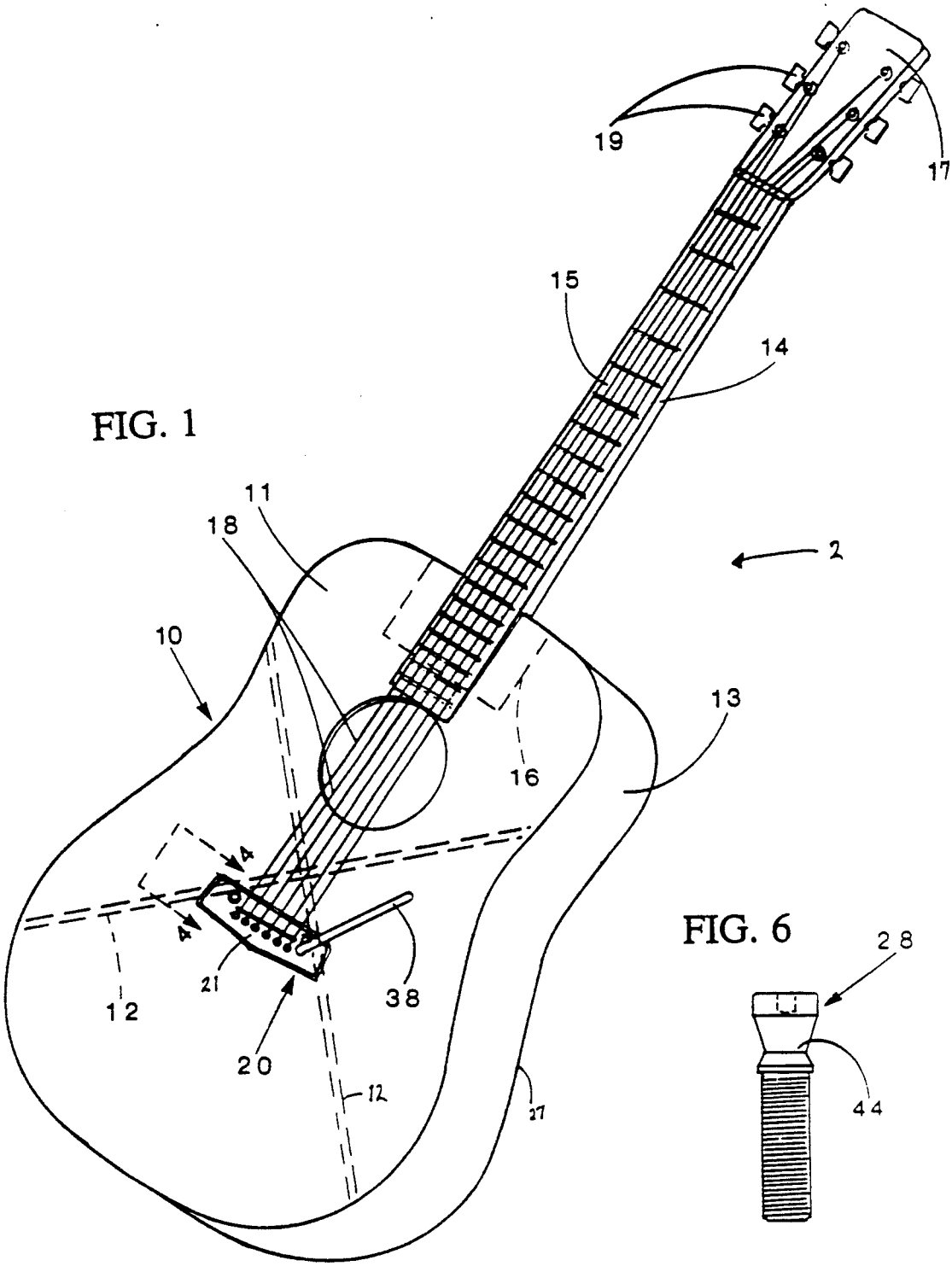
FIG. 1 is a perspective view of an acoustic guitar incorporating a preferred embodiment of the invention.
FIG. 6 is an enlarged side view of the height adjusting screw of the preferred embodiment of the present invention.

Referring now to FIG. 1, an acoustic guitar 2 is shown having a hollow or semi-hollow sound box 10 comprised of a top sound board 11, reinforced by braces 12, and a bottom sound board 27 joined to the top sound board 11 by side wall 13. The braces 12 are shown forming an "X" on the underside of top sound board box 11 but may take on any shape sufficient to provide reinforcement or support to the top board 11.

The guitar 2 further comprises a neck 14 with attached fingerboard 15 which is secured to the sound box 10 at neck block 16 by means known in the art. The neck 14 projects outwardly from sound box 10 towards peghead 17 where appropriate strings 18 attach to tuning means 19.

The tremolo device 20 in accordance with the present invention is illustrated in installed position relative to the sound box 10 and in particular top sound board 11 of the acoustic guitar 2. Typically six strings are employed on such guitars extending from tuning means 19 into top plate 21, and typically such guitars are made of a porous wooden material necessary to produce acceptable acoustic guitar sounds.

The tremolo device 20 shown in FIG. 1 has an actuating arm 38. By moving either upwards or downwards the actuating arm 38 of the tremolo device 20 constructed and mounted in accordance with the present invention, the guitar player can increase or lessen the tension placed on strings 18, producing the desired tremolo effect.

The construction of the tremolo device and its accompanying mounting means can be seen in and described with reference to FIGS. 2–6.

Figure 2:
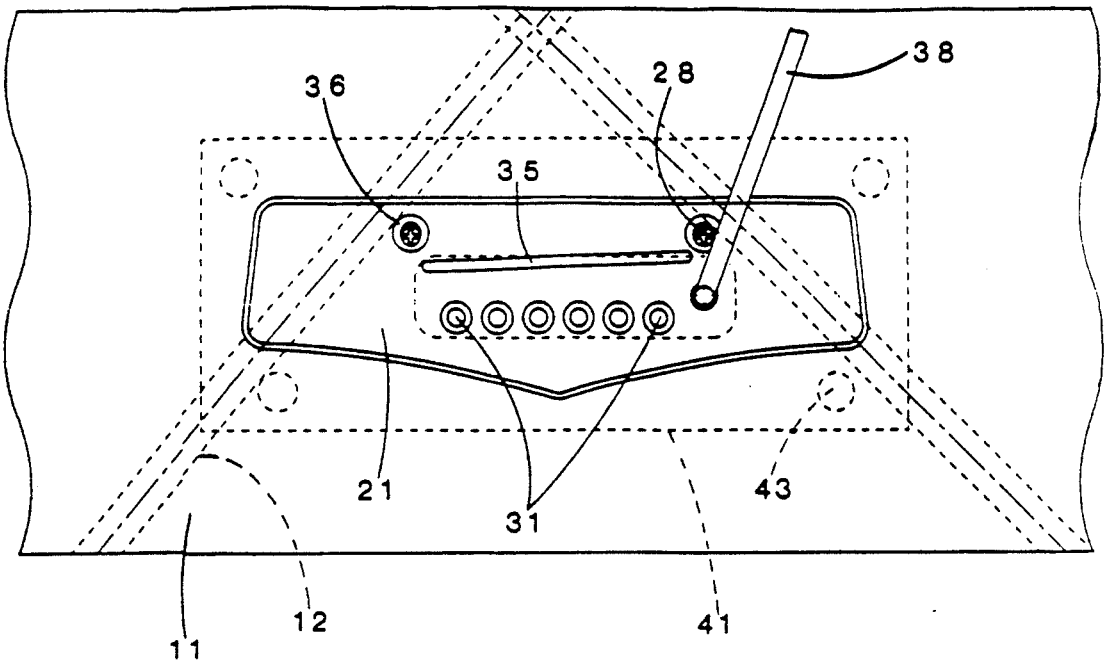
FIG. 2 is a top view of the wooden top plate of the preferred embodiment of the present invention.
Figure 3:
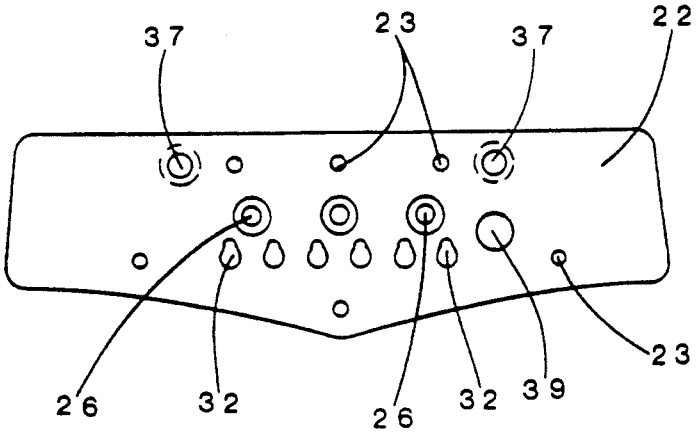
FIG. 3 is a top view of the metal base plate of the preferred embodiment of the present invention, which plate is secured in final assembly below the wooden top plate.

FIGS. 2–3 illustrate the acoustic guitar bridge in accordance with the present invention. The bridge is comprised of a preferably soft, porous top plate 21 (FIG. 2) and a metal base plate 22 (FIG. 3). The porous top plate 21 should be of a material sufficient to produce the resonant characteristics considered acceptable for acoustic guitar tone. In final assembly, the metal base plate 22 is secured to the underside of top plate 21 by screws placed through holes 23 (shown in FIG. 3). The metal base plate 22 provides the strength to withstand the stress exerted upon the bridge by the combined tension of the strings and tremolo counterbalancing springs.

The bridge is mounted onto the guitar as shown in FIGS. 2–5. The top plate 21 and accompanying metal base 22 are preferably connected to string terminator block 24 (FIGS. 4 and 5) by means of screws 25 (FIG. 4) placed though holes 26 (FIG. 3).

Figure 4:
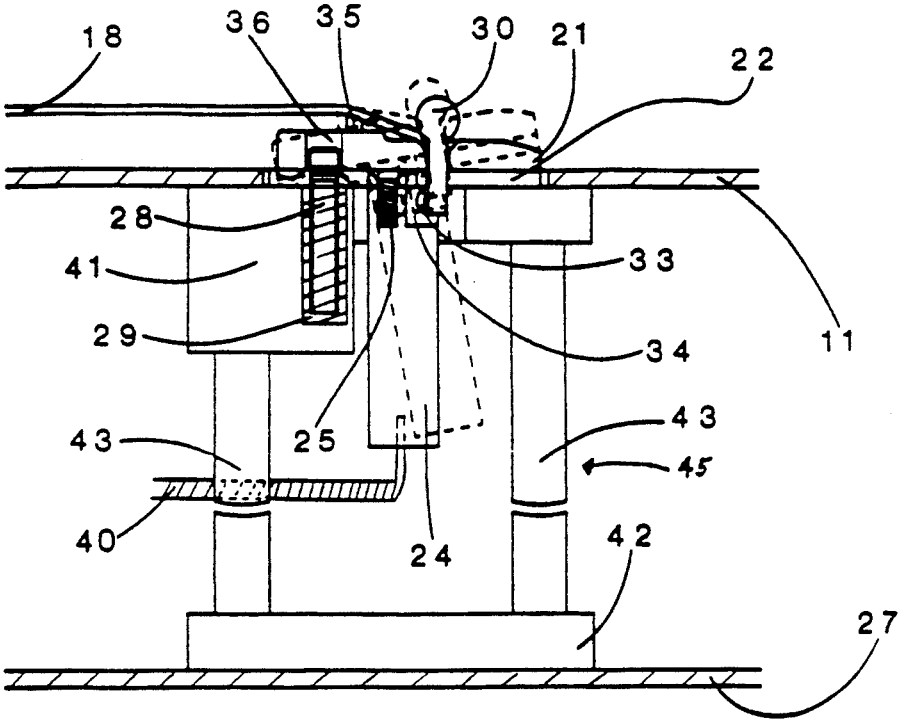
FIG. 4 is an enlarged side view of the tremolo device in accordance with the preferred embodiment of the present invention taken along the lines 4—4 of FIG. 1.

As can be seen in FIGS. 2–4, strings 18 are affixed to the tremolo device by bridge pins 30 which friction-fit through holes 31 (in top plate 21) into holes 32 (in base plate 22) to secure string ball-ends 33 by means of capturing the string ball-end in cavity 34 in string termination block 24. Exiting the holes 31, the strings then contact bridge saddle 35, which is made of bone, plastic or other appropriate material, and which is mounted by means of a receiving slot of appropriate dimension in top plate 21. The connection of the strings 18 to the tremolo device, and the manner in which the strings contact bridge saddle 35, follow means and procedures similar to what is customary for the attachment of strings to a fixed acoustic guitar bridge. As the fixed acoustic guitar bridge is the point of sound development in an acoustic guitar, the use of these means and procedures assures that the expected sound of the acoustic guitar will not be changed in a manner considered undesirable to those skilled in the art. The strings 18 thereafter proceed along the length of the guitar body and neck to the peghead 17 where they are secured to the tuning mechanism 19 by customary means.

Figure 5:
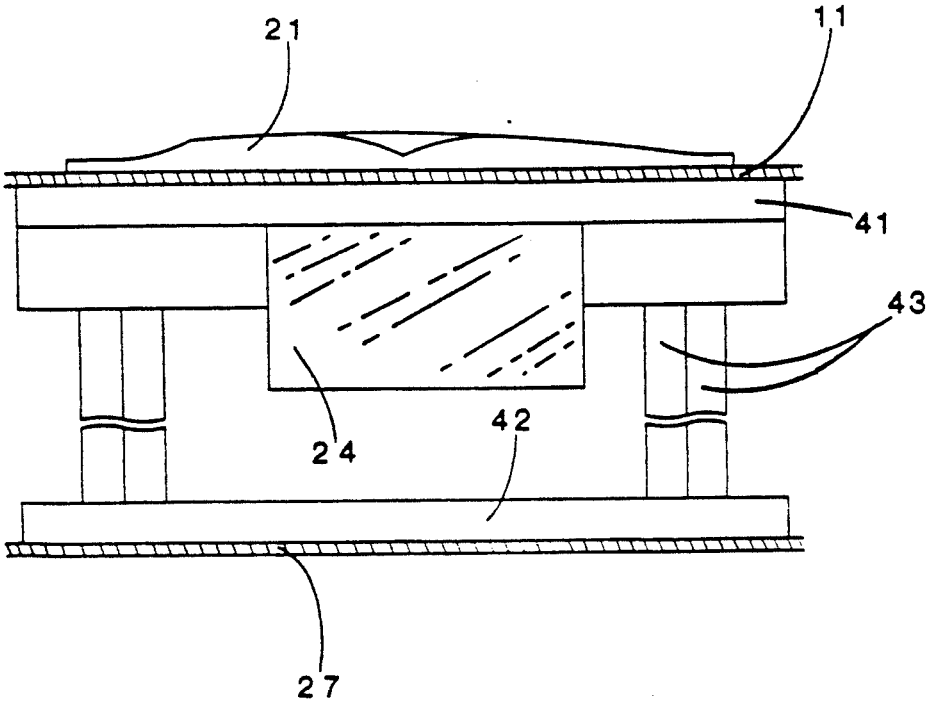
FIG. 5 is a sectional rear elevation view of the support structure forming part of the tremolo device in accordance with the preferred embodiment of the present invention.

The tremolo device 20 including the guitar bridge is supported by a support structure 45 illustrated in FIGS. 4–5 constructed in accordance with the present invention. The device 20 is mounted to the support structure 45 by bridge height adjusting screws 28 (FIG. 6) which are placed through holes 36 of top plate 21 into appropriately threaded mounting sleeves 29. (FIG. 2). This arrangement allows for vertical adjustment of the tremolo device; the player may set the distance of the strings 18 from the face of the fingerboard 15 in a manner known to those skilled in the art.

As shown in FIG. 6, the height adjusting screws 28 preferably include tapered shoulders 44 between the head of the screw and the beginning of the threaded section of the screw. Upon assembly, the head of the screw acts as a stop for the plates 21 and 22 limiting the pivoting motion of the plates. The shoulder 44 contacts knife-edged pivot 37 on base plate 22 (FIG. 3), thereby facilitating the pivoting motion (necessary to accomplish the tension variance of the strings) of the plate when tremolo actuating arm 38 is activated.

The tremolo actuating arm 38 is attached to the tremolo device in any known manner. For example, the end of the actuating arm may be threaded and screwed into appropriately threaded receiving hole 39 on the face of base plate 22. Spring 40 attaches to a customary screw-held spring claw as illustrated in aforementioned U.S. Pat. Nos. 2,741,146 to C. L. Fender, and 4,171,661 to Floyd Rose as known to those skilled in the art. The spring claw is preferably secured by means of screws to neck block 16. Spring 40 is attached to string termination block 24 by customary means of receiving holes in string termination block 24. The effect of spring 40 is to counterbalance the tension of the strings 18 to hold the tremolo device in a position substantially parallel with top sound board 11 when the tremolo device is not activated.

As mentioned above, the tremolo device must be properly secured to an acoustic guitar with proper structural reinforcement of the acoustic guitar sound box to avoid the failure of said sound box. The structural support device must also be designed in such a manner so as not to change the expected sound of the acoustic guitar in an undesirable fashion. A preferred embodiment of a support structure made of wood or any suitable material for mounting the tremolo device shall now be described with reference to FIGS. 4 and 5.

As can be seen, the mounting structure has a mounting structure top plate 41 connected to a mounting structure back plate 42 by means of vertical connecting pieces 43. Vertical connecting pieces 43 are shown as round rods for purpose of illustration, but may be of several configurations, for example rectangular or square in cross-section. Threaded mounting sleeves 29 are appropriately held in mounting structure top plate 41 to receive bridge height adjusting screws 28. Connecting pieces 43 join to top plate 41 and back plate 42 by means of adhesive glue or any customary method, for example, screws. The strength of said mounting structure top plate, back plate and connecting pieces, when assembled as a unit as shown in FIG. 5, and installed within the sound box 10, is sufficient to withstand the forces exerted upon it by the mounting and use of the tremolo device as described above without harm to the sound box of the acoustic guitar.

When mounted within the hollow sound box 10, the described supporting structure preferably will abut braces 12 thereby transferring the vibration of the strings 18 through said braces into the sound box top 11, thus producing the action of sound production in accordance with that experienced in a standard acoustic guitar. It is in this manner that the support structure contributes to the maintenance of the integrity of the expected sound of the acoustic guitar.

In use, the player may press downward or pull upward on actuator arm 38 causing the tremolo device to tilt respectively forward or backward against the tapered shoulder on the underside of the head of bridge height adjusting screw 28 resulting in the lessening or increasing of tension of the strings 18, producing the desired tremolo effect. Spring 40 has the effect of returning the tremolo device to its original position when actuator arm 38 is released.

The above detailed description of the assembly and use of the tremolo device and attendant mounting structure illustrates the provision of means to raise and lower the tension of the strings of an acoustic guitar for the purposes of producing a tremolo effect while preserving the expected tone of the acoustic guitar and eliminating stress on the top sound board of the acoustic guitar caused by the mounting of such a tremolo device.

It should be noted that the specific embodiment shown here has been for illustration purposes only, and not for purpose of limitation. Many modifications may be made by one skilled in the guitar art to the mechanism detailed above while using the same principals explained within the teaching of the specification. For example, the internal mounting structure illustrated might be made from a casting of plastic, or milled from a solid block of aluminum or other material in contrast to the illustrated structure of several joined components. It is conceivable that the strings may be attached to the tremolo device by passing them through holes in a raised vertical member at the rear edge of top plate 21, the strings thus being held in position by their own tension, where I have illustrated bridge pins 30. It is feasible that braces 12 do not terminate at the point said braces abut the internal support structure as described, but are cut in such a manner as to permit said braces to continue over said support structure without terminating. It is also possible that one or more piezo-electric transducer elements could be positioned beneath bridge saddle 35, or attached to any area of the bridge for purposes of amplification. These examples are not intended to mean that all possible modifications have been outlined. The modifications are cited only to reveal some of many examples of modifications that exist within the teaching of the specification and that will occur to those skilled in the art upon a reading of the specification.

I claim:

1. A tremolo assembly to produce a desired tremolo effect in and to preserve the acoustic sound of a substantially hollow acoustic guitar having a substantially hollow sound box comprised of a top sound board and a bottom sound board joined by side walls, comprising plate means pivotedly mounted to the top of said sound board for receiving the strings of the guitar, actuating means attached to said plate means for actuating pivotal movement of said plate means, and support means fixedly attached to the underside of said top sound board at the location of said plate means for supporting said plate means and countering excessive stress placed upon the acoustic guitar by said pivotal movement, whereby manual operation of the actuating means causes said plate means to pivot and thus vary the tension of the strings of the guitar to produce the desired tremolo effect.

2. The tremolo assembly of claim 1, wherein said support means is further fixedly attached to the innerside of said bottom sound board.

3. The tremolo assembly of claim 1, further including height adjusting means adjustably connecting said plate means to said top sound board.

4. The tremolo assembly of claim 3, wherein said height adjusting means includes means for limiting the pivotal action of said plate means.

5. The tremolo assembly of claim 3, wherein said support means includes means for anchoring said height adjusting means.

6. The tremolo assembly of claim 1, further including stop means fixedly attached to said plate means for limiting the pivotal action of said plate means.

7. The tremolo assembly of claim 1, further including bridge saddle means at said plate means spanning the strings of the guitar for transferring the vibration of the acoustic guitar strings through said plate means.

8. A tremolo assembly to produce a desired tremolo effect in and to preserve the acoustic sound of an acoustic guitar having a substantially hollow sound box comprised of a top sound board and a bottom sound board joined by side walls, comprising plate means pivotedly mounted to the top of said sound board for receiving the strings of the guitar, actuating means attached to said plate means for actuating pivotal movement of said plate means, and support means fixedly attached to the underside of said top sound board at the location of said plate means for supporting said plate means and countering excessive stress placed upon the acoustic guitar by said pivotal movement, whereby manual operation of the actuating means causes said plate means to pivot and thus vary the tension of the strings of the guitar to produce the desired tremolo effect, and wherein said plate means comprises a top plate constructed of a porous wooden material and a metal based bottom plate, said top plate being fixedly attached to said bottom plate.

9. A tremolo assembly to produce a desired tremolo effect in and to preserve the acoustic sound of an acoustic guitar having a substantially hollow sound box comprised of a top sound board and a bottom sound board joined by side walls, comprising plate means pivotedly mounted to the top of said sound board for receiving the strings of the guitar, actuating means attached to said plate means for actuating pivotal movement of said plate means, and support means fixedly attached to the underside of said top sound board at the location of said plate means for supporting said plate means and countering excessive stress placed upon the acoustic guitar by said pivotal movement, whereby manual operation of the actuating means causes said plate means to pivot and thus vary the tension of the strings of the guitar to produce the desired tremolo effect, and wherein said support means is further fixedly attached to the innerside of said bottom sound board, and wherein said support means comprises a mounting structure top plate attached to the underside of said top sound board and a mounting structure back plate attached to the innerside of said bottom sound board and connecting means for connecting said mounting structure top and back plates.

10. The tremolo assembly of claim 9, wherein said connecting means comprises a plurality of connecting pieces.

11. The tremolo assembly of claim 10, wherein said support means is constructed of wooden material.

12. The tremolo assembly of claim 11, wherein said support means is attached to the top and bottom sound boards by glue.

13. A tremolo assembly to produce a desired tremolo effect in and to preserve the acoustic sound of an acoustic guitar having a substantially hollow sound box comprised of a top sound board and a bottom sound board joined by side walls, comprising plate means pivotedly mounted to the top of said sound board for receiving the strings of the guitar, actuating means attached to said plate means for actuating pivotal movement of said plate means, and support means fixedly attached to the underside of said top sound board at the location of said plate means for supporting said plate means and countering excessive stress placed upon the acoustic guitar by said pivotal movement, whereby manual operation of the actuating means causes said plate means to pivot and thus vary the tension of the strings of the guitar to produce the desired tremolo effect, and wherein said top sound board includes on its underside a plurality of braces for supporting said top sound board and wherein said support means abuts at least one of said braces, whereby string vibration is transferred through said braces into said top sound board.

14. A tremolo assembly to produce a desired tremolo effect in and to preserve the acoustic sound of an acoustic guitar having a substantially hollow sound box comprised of a top sound board and a bottom sound board joined by side walls, comprising plate means pivotedly mounted to the top of said sound board for receiving the strings of the guitar, actuating means attached to said plate means for actuating pivotal movement of said plate means, and support means fixedly attached to the underside of said top sound board at the location of said plate means for supporting said plate means and countering excessive stress placed upon the acoustic guitar by said pivotal movement, whereby manual operation of the actuating means causes said plate means to pivot and thus vary the tension of the strings of the guitar to produce the desired tremolo effect, and further including string termination means attached to the underside of said plate means and pivotal therewith for anchoring the guitar strings, and spring means attached to said string termination means for counterbalancing the tension placed on the strings.

15. In a substantially hollow acoustic guitar having a substantially hollow sound box, a tremolo assembly, comprising tremolo means for varying the tension of the strings of the guitar, said tremolo means pivotedly attached to said sound box, support means for supporting said tremolo means, said support means fixedly attached to the inside of the hollow sound box, and actuator means attached to said tremolo means for actuating the pivotal movement of said tremolo means and causing a varying tension of the strings of the guitar.

16. The tremolo assembly of claim 15, further including bridge height adjusting means adjustably connecting said tremolo means to said sound box and wherein said support means include mounting means for receiving said bridge height adjusting means, and said bridge height adjusting means including a section positioned above said hollow sound box for limiting the pivotal motion of said tremolo means.

17. In an acoustic guitar having a substantially hollow sound box, a tremolo assembly, comprising tremolo means for varying the tension of the strings of the guitar, said tremolo means pivotedly attached to said sound box, support means for supporting said tremolo means, said support means fixedly attached to the inside of the hollow sound box, and actuator means attached to said tremolo means for actuating the pivotal movement of said tremolo means and causing a varying tension of the strings of the guitar, and further including bridge height adjusting means adjustably connecting said tremolo means to said sound box and wherein said support means include mounting means for receiving said bridge height adjusting means, and said bridge height adjusting means including a section positioned above said hollow sound box for limiting the pivotal motion of said tremolo means, and wherein said tremolo means comprises a top plate constructed of a porous wooden material and a metal based bottom plate, said top plate fixedly attached to said bottom plate, and further comprises string termination means for anchoring the guitar strings in the sound box, and spring means for counterbalancing the tension placed on the strings.

18. The tremolo assembly of claim 17, wherein said support means is constructed of wood and includes a mounting top plate attached to the innerside of the top of the sound box and a mounting bottom plate attached to the innerside of the bottom of the sound box, said mounting plates connected by connecting means.

19. The tremolo assembly of claim 18, wherein said sound box includes brace means for supporting the box and wherein said support means abuts said brace means.

20. A mounting assembly to support a tremolo device in a substantially hollow acoustic guitar having a hollow sound box comprised of a top sound board and a bottom sound board joined by side walls, comprising a mounting structure top plate affixed to the underside of said top sound board at the location of said tremolo device and a mounting structure bottom plate affixed to the innerside of said bottom sound board; and connecting means having at least one support leg for connecting said mounting structure top and bottom plates, whereby said mounting assembly provides support to withstand the forces exerted upon the sound box upon actuation of the tremolo device.

* * * * *

UNITED STATES PATENT AND TRADEMARK OFFICE

CERTIFICATE OF CORRECTION

PATENT NO. : 5,305,675

DATED : April 26, 1994

INVENTOR(S) : Richard Lasner

It is certified that error appears in the above-indentified patent and that said Letters Patent is hereby corrected as shown below:

Col. 3, line 2, "o the" should read -- on the --. Col. 4, line 17, "the a" should read -- the appended --.

Signed and Sealed this

Thirtieth Day of August, 1994

*Attest:*

*Attesting Officer*

BRUCE LEHMAN

*Commissioner of Patents and Trademarks*